United States Patent [19]

Silver

[11] 4,326,308

[45] Apr. 27, 1982

[54] HYGIENIC DEVICE PROVIDING SITZ BATH, SHOWER, AND DOUCHE

[76] Inventor: Louis Silver, 5825 Collins Ave., Miami Beach, Fla. 33140

[21] Appl. No.: 141,374

[22] Filed: Apr. 18, 1980

Related U.S. Application Data

[63] Continuation-in-part of Ser. No. 33,456, Apr. 26, 1979, Pat. No. 4,287,618.

[51] Int. Cl.[3] ..... A61H 35/00; B05B 1/16

[52] U.S. Cl. ..... 4/420.3; 4/420.4; 4/444; 4/445; 4/447

[58] Field of Search ..... 4/443–448, 4/420.1–420.5, 242, 579, 615, 237, 619; 128/231, 207.25

[56] References Cited

U.S. PATENT DOCUMENTS

| | | | |
|---|---|---|---|
| 1,838,356 | 12/1931 | Berry | 4/448 X |
| 1,988,737 | 1/1935 | Jaurequi | 4/420.4 |
| 2,075,061 | 3/1937 | Salvoni | 4/420.3 |
| 2,112,662 | 3/1938 | Bentz | 4/579 |
| 2,139,951 | 12/1938 | Gaston et al. | 4/444 |
| 2,427,807 | 9/1947 | Oliver | 4/445 |
| 2,722,933 | 11/1955 | Allen | 128/231 |
| 2,957,180 | 10/1960 | McMullen | 4/420.2 |
| 3,034,137 | 5/1962 | Glou | 4/445 |
| 3,072,918 | 1/1963 | McCall et al. | 4/445 |
| 3,288,140 | 11/1966 | McCarthy | 4/420.1 |
| 3,430,267 | 3/1969 | Van Hooten | 4/420.4 X |
| 3,528,112 | 9/1970 | Warnick | 4/447 X |
| 3,577,567 | 5/1971 | Wintercorn | 4/445 |
| 3,654,636 | 4/1972 | Restyanski | 4/445 |
| 3,772,710 | 11/1973 | Coutiller | 4/443 |
| 3,812,543 | 5/1974 | Stinson | 4/446 |
| 3,902,200 | 9/1975 | Pratt | 4/579 |
| 3,947,898 | 4/1976 | Ducharme | 4/447 |
| 3,995,326 | 12/1976 | Umann | 4/420.1 |
| 4,069,520 | 1/1978 | Thomas | 4/446 |

FOREIGN PATENT DOCUMENTS

| | | | |
|---|---|---|---|
| 1919057 | 10/1970 | Fed. Rep. of Germany | 4/420.3 |
| 262023 | 12/1926 | United Kingdom | 4/242 |

*Primary Examiner*—Stuart S. Levy
*Attorney, Agent, or Firm*—Ronald E. Smith

[57] ABSTRACT

An apparatus usable with conventional toilet structures, said apparatus of the type designed for providing sitz bath, sitz shower, and other such treatments of the general peri-anal area.

A conduit means preferably extends vertically through an aperture formed in a toilet seat so that one end of the conduit is disposed upwardly of the toilet seat and the other end of the conduit is disposed downwardly of the seat, but in non-interfering relationship with the toilet bowl portion of the structure so that normal use thereof can be made even when the conduit is in its functional position.

The upper end of the conduit is brought into fluid communication with a source of fluid under pressure by a flexible hose carrying a flow control valve at its end that releasably connects to the upper end of said conduit. The lower end of the conduit is adapted to releasably connect with a plurality of implements through which said fluid ultimately flows, and one of said implements carries a basin thereabout for providing either static or dynamic sitz baths.

4 Claims, 4 Drawing Figures

HYGIENIC DEVICE PROVIDING SITZ BATH, SHOWER, AND DOUCHE

CROSS REFERENCE TO RELATED APPLICATIONS

This disclosure is a continuation-in-part of co-pending application Ser. No. 33,456, filed Apr. 26, 1979, now U.S. Pat. No. 4,287,618.

BACKGROUND OF THE INVENTION

1. Field of the Invention

This invention relates generally to apparatus' for administering therapeutic treatment to individuals suffering from ailments or disorders of the peri-anal area, and specifically relates to an apparatus the major portion of which can be permanently but releasably mounted to a conventional toilet structure and to such an apparatus the minor portion of which connects to said mounted portion due to the provision of snap fit-type adapters so that the user of the invention can attach the minor, or peripheral, portions of the invention to the major portion thereof in the absence of screw-threaded connections.

2. Description of the Prior Art

The following patent literature was procured as a result of a search of U.S. patents: U.S. Pat. Nos. 1,988,737; 3,577,567; 2,075,061; 2,957,180; 3,430,267; and 3,072,918.

The known devices are complex in structure and therefor require considerable time and effort to assemble. An easily assembleable structure of the type desired, usable with a plurality of therapeutic instruments, does not appear in the prior art.

SUMMARY OF THE INVENTION

A longstanding but heretofore unfulfilled need is therefor seen to exist for an economical-to-manufacture and easy to assemble device that can provide a plurality of treatments for the peri-anal area.

The existing need is now fulfilled by an apparatus comprising a toilet seat having suction cup means on the underside thereof for non-slip engagement of a toilet bowl rim. A conduit means impales said seat so that one end of the conduit can be attached to a water faucett by a flexbile hose disposed upwardly of the toilet seat. The other end of the conduit means is connectable to several different implements that provide several different forms of treatment of the type needed to soothe areas affected by hemorrhoids, fissures, and the like. The treatments provided include sitz showers of differing types, sitz baths of differing types, douches, and the like. The device also promotes personal hygiene, especially for those individuals suffering from disorders so acute that wiping contact of the peri-anal area is contraindicated.

The invention accordingly comprises the combination of elements, features of construction, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
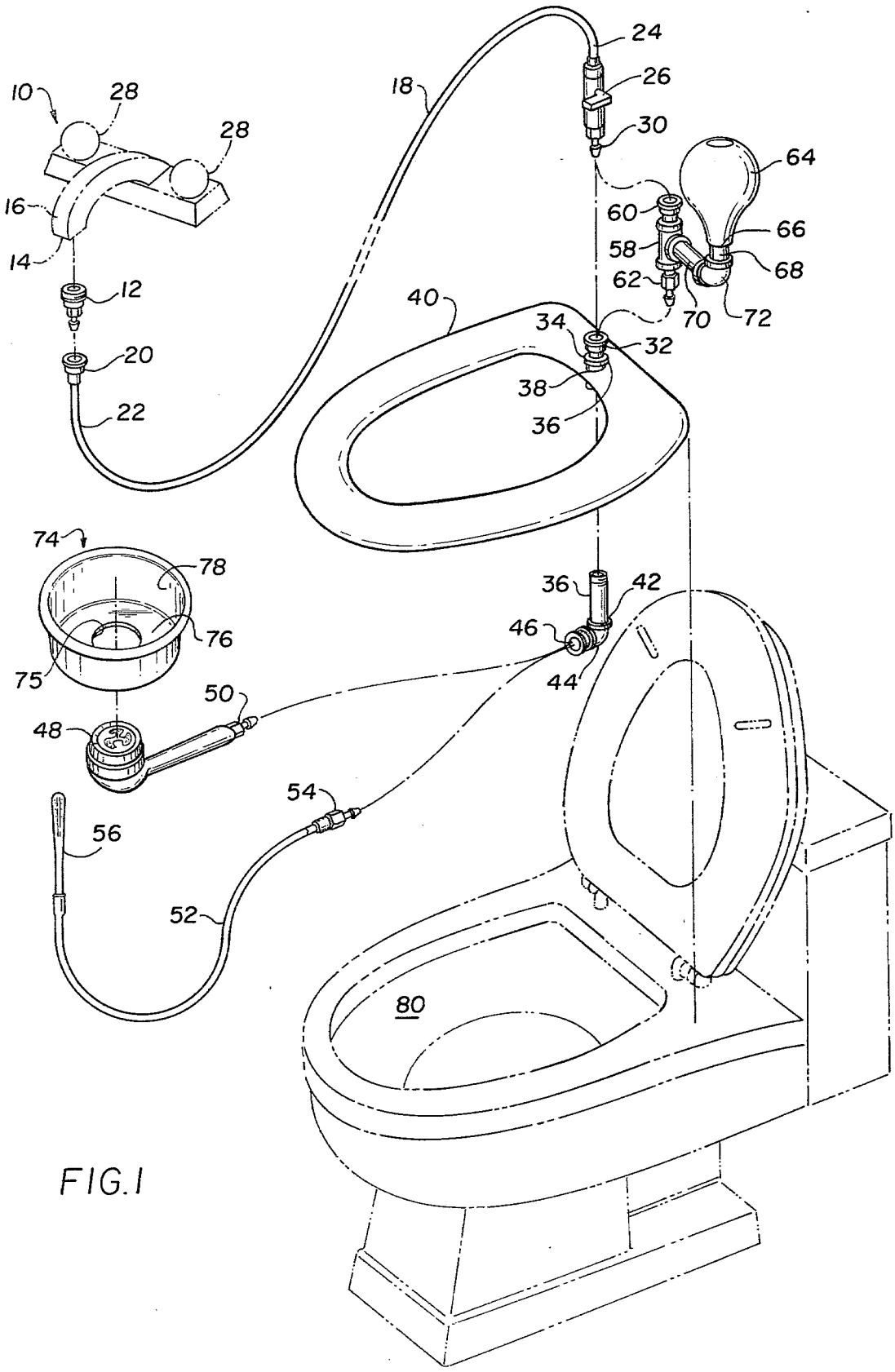
FIG. 1 is an exploded perspective view of the preferred embodiment of the inventive apparatus, showing the possible combinations of its constituent parts.

Referring now to FIG. 1, it will be seen that a conventional faucett means, designated 10 as a whole, is provided with an aerating-type adapted means 12 that is preferably permanently secured to the discharge spout 14 of the spigot 16.

The flexible hose 18 is preferably of polyvinylchloride construction, and an adapted member 20 of the snap-fit type is provided adjacent end 22 thereof for releasable snap-fit engagement with the aerating adapter 12.

The specific structure of the adapter members 12 and 20, as well as the structure of further adapter members to be mentioned hereinafter, forms no part, per se, of the invention, but the provision thereof is important so that the inventive apparatus can be quickly and easily attached and detached to the existing sink and toilet structures with which the invention is used.

The opposing end 24 of the hose 18 carries a flow control valve means 26 that has an infinite number of functional positions of flow-throttling adjustment between its fully open and fully closed positions. To adjust the temperature of the water or other fluid flowing through the hose 18, adapter members 12 and 20 are connected by pressing the same together, valve 26 is opened, and the conventional hot and cold water handles 28,28 are manipulated in the conventional manner until water of the desired temperature is flowing through the valve 26. This temperature-setting procedure is performed at the sink basin (not shown) associated with the faucet 10, so that the drain associated therewith can be utilized. Having adjusted the water temperature, the valve 26 is closed and the handles 28,28 are left in their respective desired positions. In this manner, when the inventive therapeutic apparatus is assembled as set forth hereinafter, the user of the invention need not leave his or her position on the toilet seat 40 to adjust the temperature of or the flow rate of water flowing through the hose 18, since the temperature has been pre-set as described above, and the valve 26, which is conveniently positioned, need only be manipulated. When the treatment has been completed, valve means 26 is closed, the handles 28, 28 are closed, and water in the hose 18 is drained therefrom at the sink basin (not shown) by de-coupling adapter members 12 and 20.

Figure 2:
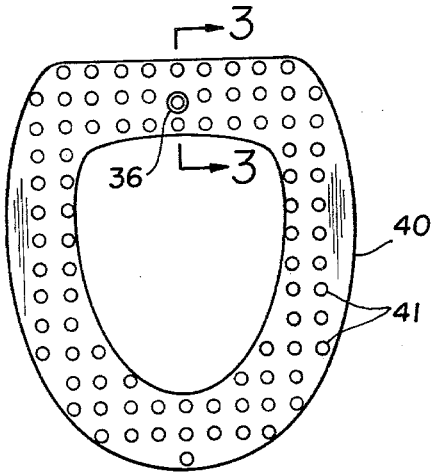
FIG. 2 is a bottom plan view of the preferred toilet seat that forms a part of the invention, showing suction cup means arrayed thereon in contiguous relation to at least one other of said suction cup means.
Figure 3:
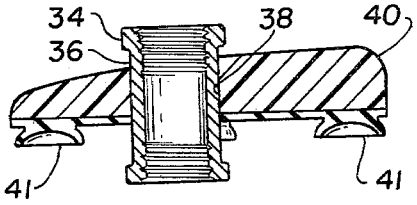
FIG. 3 is a vertical cross sectional view taken along line 3—3 of FIG. 2.
Figure 4:
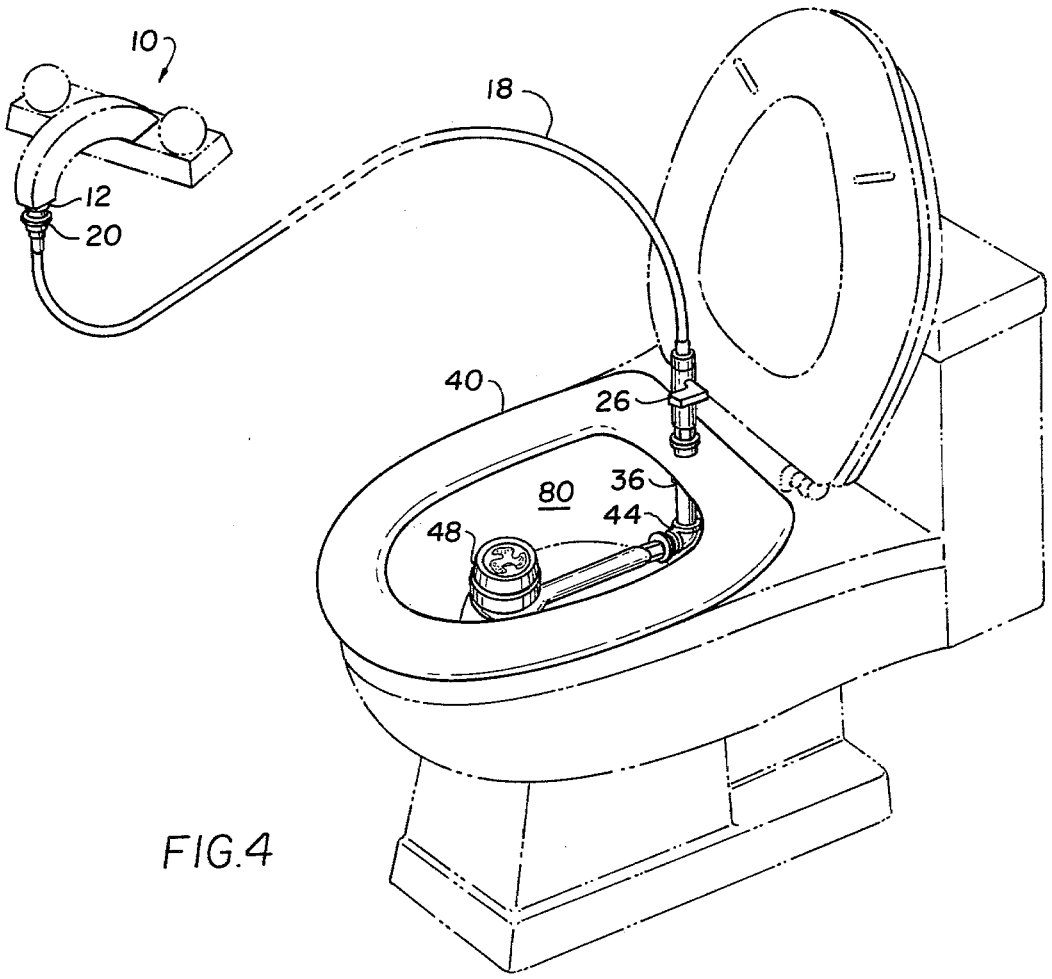
FIG. 4 is a perspective view of one embodiment of the invention in its assembled configuration.

The valve means 26 also carries an adapter member 30 for snap-fit engagement with an adapter member 32 that is mounted on the upper end 34 of a conduit means 36 that extends through an aperture 38, best seen in FIG. 2, formed in the novel toilet seat 40. The lower end 42 of the conduit 36 has an elbow portion that terminates in adapter member 46, said elbow portion designated 44. Adapter 46 in turn snapfittingly mates with either a spray head means 48 having an adapter 50 associated therewith, or a second PVC flexible hose means 52 having an adapter 54 at one end thereof and a douche implement 56 or an enema implement (not shown) disposed at the other end thereof.

A second conduit member 58 has adapter members 60,62 at its opposing ends so that it can be interposed in fluid communication between adapter 30 associated with flow control valve 26 and adapter member 32 disposed at the upper end 34 of the first conduit means 36. A deformable, preferably bulbous reservoir means 64 has its charging and discharging spout 66 in fluid communication with the second conduit 58 via nipple members 68,70 and elbow member 72. It will be observed that interposing the second conduit means 58 between adapter members 30 and 32 allows administration of a douche when hose 52 adapter 54 is connected to adapter 46. Closing valve 26 allows a medicinal solution contained within the deformable bulbous means 64 to be administered through implement 56 via hose 52 in undiluted form, whereas opening valve 26 admits a mixture of medicinal solution and water into the implement 56, thus providing a diluted douche if such has been prescribed. Squeezing member 64 discharges the solution.

A basin means 74 having a centrally-apertured bottom wall 76, upstanding sidewalls 78 and an open top is provided with an annular gasket means (not shown) about the periphery of said aperture so that said basin 74 may be removably mounted on said spray head means 48 so that said spray head 48 protrudes through said aperture in the manner depicted in FIG. 1, to the end that water can be introduced into said basin 74 through the spray head 48 and retained in the basin 74, without leaking through aperture 75.

The basin 74 is specifically structured and positioned so that, when full, the level of water retained therein is substantially co-planar with the plane of the seat 40 so that a sitz bath treatment can be administered to an individual properly seated on seat 40. A static sitz bath is provided by filling the basin 74 as aforesaid by opening valve 26 until the basin 74 is full, and then closing valve 26. If the water temperature falls below the desired temperature, valve 26 may be re-opened to re-supply the basin 74 with a new supply of water. Water overflowing from the basin 74 is collected by the toilet bowl 80 of the existing toilet structure. A dynamic sitz bath is provided by leaving valve 26 open throughout the duration of the treatment.

A sitz shower is administered with basin 74 removed from shower head 48. The preferred shower head 48 is of the commercially available type that delivers a full range of water flow forms, from gentle, steady state streams to vigorously pulsating bursts of water.

Both types of sitz baths, and all types of sitz showers stimulate blood circulation in the affected area, and thereby serve to reduce swelling of hemorroidal tissue and to reduce pain concomitant therewith. Further, the flow of water over the affected area allows the user of the invention to maintain a state of personal cleanliness even if the ailment being treated is so acute that the affected area can not be touched or wiped.

It will thus be seen that the objects of the invention, that have been made apparent in the foregoing description, are efficiently attained, and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. An apparatus useful for treatment of ailments of the peri-rectal area, comprising, a conventional toilet bowl, a toilet seat removably mounted in operable relation to said toilet bowl, said removably mounted toilet seat being provided in lieu of the conventional hingedly mounted toilet seat, which conventional toilet seat is placed in its open position when the removably mounted seat is in use, said removably mounted toilet seat provided with a substantially vertically aligned aperture than extends completely therethrough, a first conduit member extending through said aperture so that the uppermost end of said conduit member is disposed upwardly of the plane defined by said removably mounted toilet seat and so that its lowermost end is disposed downwardly of said plane, a first elongate, flexible hose member having its opposed ends adapted for respective releasable engagement with a conventional spigot and the uppermost end of said conduit member so that fluid under pressure is carried by said hose from said spigot to said conduit, a flow control valve disposed in the end of said flexible hose adjacent said conduit so that flow of fluid through said hose can be throttled by the user of the apparatus when such user is seated upon said apparatus, a second elongate, flexible hose member having its opposed ends respectively adapted for releasable engagement with the lowermost end of said first conduit member and with a douche implement means for releasably connecting a shower head member to the lowermost end of said first conduit member, in lieu of said second hose member and said douche implement, so that said shower head member is disposed in cantilevered relation to said lowermost end of said first conduit member, a basin member having an apertured bottom wall through which the operative portion of said shower head member extends, said shower head member being the sole means of supporting said basin member, said basin member having its rim disposed in substantially coplanar relation to said removably mounted toilet seat, so that a static size bath treatment is provided when said basin member is filled with fluid and so that a dynamic size bath treatment is provided when said basin member is filled with fluid and said shower head member is discharging fluid from said source of fluid under pressure.

2. The apparatus of claim 1, further comprising, a second conduit member having its opposed ends adapted for respective releasable engagement with the uppermost end of said first conduit member and the end of said hose carrying said flow control valve, a bulbous, hand deformable squeeze member having a discharge spout in fluid communication with said second conduit member so that medicine in said squeeze member can be dispensed through said discharge spout and hence through said douche implement in undiluted condition when said flow control valve is closed and dispensed in diluted conditon attendant differing settings of said flow control valve.

3. The apparatus of claim 2, wherein said aperture formed in said toilet seat is disposed at the rearward portion of said seat so that a person seated on said seat, facing rearwardly, can easily manipulate said throttling valve or squeeze said bulbous member.

4. The apparatus of claim 3, wherein said basin member is removably mounted with respect to said shower head member so that a stiz shower treatment is provided upon removal of said basin member from its supported engagement with said shower head member.

* * * * *